US005530983A

United States Patent [19]

Maltese

[11] Patent Number: 5,530,983

[45] Date of Patent: Jul. 2, 1996

[54] APPLIANCE FOR WASHING, MASSAGING, OR HEAT-TREATING THE BACK

[76] Inventor: Roy D. Maltese, 22131 Cleveland - Apt. 103, Dearborn, Mich. 48124

[21] Appl. No.: 270,264

[22] Filed: Jul. 5, 1994

[51] Int. Cl.[6] ..... A47K 7/02; A61H 15/00; A61H 15/02

[52] U.S. Cl. ..... 15/160; 15/143.1; 601/15; 601/135; 601/137; D4/130; D24/206; D24/211; D24/214; D24/215

[58] Field of Search ..... 15/143.1, 160, 15/210.1, 244.1; 601/15, 134–138; D4/130, 134, 137, 138; D24/200, 206, 211, 214, 215

[56] References Cited

U.S. PATENT DOCUMENTS

| | | | |
|---|---|---|---|
| D. 185,246 | 5/1959 | Taran | D24/211 |
| D. 268,362 | 3/1983 | Wong | D24/214 |
| D. 336,959 | 6/1993 | Liming | D24/214 |
| D. 340,527 | 10/1993 | Goodell | D24/214 |
| 775,077 | 11/1904 | Dettmer | 15/143.1 |
| 1,431,881 | 10/1922 | Ericson-Smith . | |
| 1,437,296 | 11/1922 | Dyer . | |
| 1,612,343 | 12/1926 | Amussen | D24/200 |
| 2,039,052 | 4/1936 | Beck et al. | 15/160 |
| 2,168,975 | 8/1939 | Clarke . | |
| 2,576,338 | 11/1951 | Gamble | 15/160 |
| 3,085,276 | 4/1963 | Swanson, Jr. | 601/138 |
| 3,568,237 | 3/1971 | Rhodes . | |
| 3,935,611 | 2/1976 | Locher | 15/160 |
| 4,266,536 | 5/1981 | Casares . | |
| 4,381,766 | 5/1983 | Avolio | 15/143.1 |
| 4,718,409 | 1/1988 | Gershov et al. . | |
| 4,798,198 | 1/1989 | Wright . | |

FOREIGN PATENT DOCUMENTS

| | | | |
|---|---|---|---|
| 712391 | 10/1931 | France | 15/143.1 |
| 2433140 | 1/1975 | Germany | 15/160 |
| 2808692 | 9/1979 | Germany | 15/244.1 |

*Primary Examiner*—Mark Spisich
*Attorney, Agent, or Firm*—Charles W. Chandler

[57] ABSTRACT

A back brush with a generally U-shaped handle such that the user can manipulate the brush or other back-treating appliance by using one of his hands in front of his body to manipulate the appliance.

5 Claims, 2 Drawing Sheets

APPLIANCE FOR WASHING, MASSAGING, OR HEAT-TREATING THE BACK

BACKGROUND OF THE INVENTION

This invention is related to a back appliance for brushing, massaging, or heat-treating the user's back. The appliance has a handle supported under the user's arm with one hand. He manipulates the appliance with his other hand disposed in front of his body.

Many people prefer to brush their back while bathing. A typical brush has a relatively short handle that requires the user to raise his hand over his shoulder to apply an up and down motion to the brush. This type of brush configuration is typical for many appliances used for massaging or applying a cleansing or other material to the back. For example, U.S. Pat. No. 2,576,338 which was issued Nov. 27, 1951 to Bessie B. Gamble for "Bath Brush"; U.S. Pat. No. 3,568,237 which was issued Mar. 9, 1971 to William L. Rhodes for "Sponge Back Washer"; and U.S. Pat. No. 3,935,611 which was issued Feb. 3, 1976 to Lorenz Locher for "Brush for the Care and Cleaning of Things and the Body" show back brushes or sponges.

U.S. Pat. No. 2,168,975 which was issued Aug. 8, 1939 to Dumont Clarke illustrates a "Massaging Device" that requires the user to raise at least one hand to the height of his shoulders.

U.S. Pat. No. 1,431,881 which was issued Oct. 10, 1922 to Helen Erickson-Smith for "Toilet Powder Applying Device or Implement" illustrates a device for applying toilet powder to a user's back.

U.S. Pat. No. 2,039,052 which was issued Apr. 28, 1936 to Robert W. Beck and Gustav A. Rogge for "Resilient Means for Bath Brushes" and U.S. Pat. No. 1,437,296 which was issued Nov. 28, 1922 to Warren C. Dyer for "Bathing Appliance" illustrate a pair of bathing appliances for treating the back while the handle is held in front of the bather's body.

However, some people are partially disabled such that it is either difficult or painful for them to raise their hands to the shoulder level. It is very painful to use a conventional brush that requires the user to manipulate the handle from the level of his shoulders. Further, such brushes generally limit the user to an "up and down" motion to clean his back. The brushes are formed such that the user cannot use both hands to apply sufficient leverage to effectively apply a sideways motion unless he can raise at least one arm.

SUMMARY OF THE INVENTION

The preferred embodiment of the invention comprises an elongated tubular body having a handle on one end and a working element on the other. The working element may be a scrubbing brush, a massage unit, a heating element, or any of a variety of other appliances useful for treating or applying a skin treatment material to the back.

The preferred embodiment has an elongated tubular body with a generally J-shaped configuration with the major portion of the body lying in a plane. The short arm of the body carries a brush. The outer end of the long arm is bent to form a handle extending in a direction generally perpendicular to the body. The body has a sufficiently open configuration that it can be disposed beneath the user's arm with the handle in front of his body and the brush contacting his back. The midsection of the body is held with one hand.

The handle is pivoted by his other hand to swing the brush back and forth.

This structure provides several advantages over conventional brushes. It permits the user to brush his back without having to raise his arms to the level of his shoulders. Further, it permits the user to readily apply a sideways motion to the brush. In addition, it permits him to use both hands to apply pressure on his back while swinging the brush.

Another embodiment of the invention comprises a brush having a generally U-shaped configuration with a working element at one end and a handle at the other end. In this case, the handle and the brush are spaced a distance greater than the depth of the U-shaped body. This shape has particular utility because it permits the manipulating hand to be placed in a comfortable position in front of his body so that he can employ both hands to either swing the brush in a sideways motion, or, to apply an up and down motion without raising either hand to the level of his shoulders.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF A PREFERRED EMBODIMENT

Figure 1:
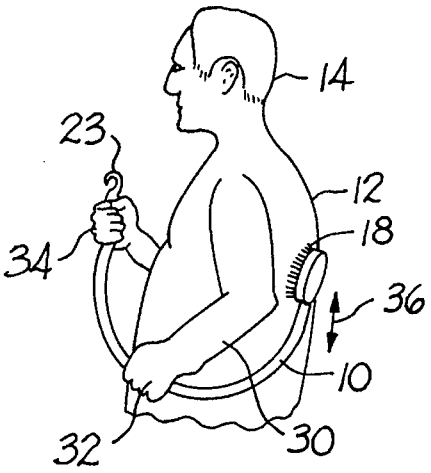
FIG. 1 illustrates a preferred brush being used on a bather's back.

Referring to the drawings, a preferred brush appliance is illustrated in FIG. 1 at 10 being used on the back 12 of a bather 14. Brush applicance 10 has an elongated rigid tubular support body 19 having one end 16 rigidly attached to a brush element 18. The brush body can also be formed of a rigid plastic material. The other end 20 of the appliance 10 carries a handle element 22 with a hook 23 for hanging when not in use. As best illustrated in FIG. 2, the elongated body of the brush appliance has a generally U-shaped configuration.

Figure 2:
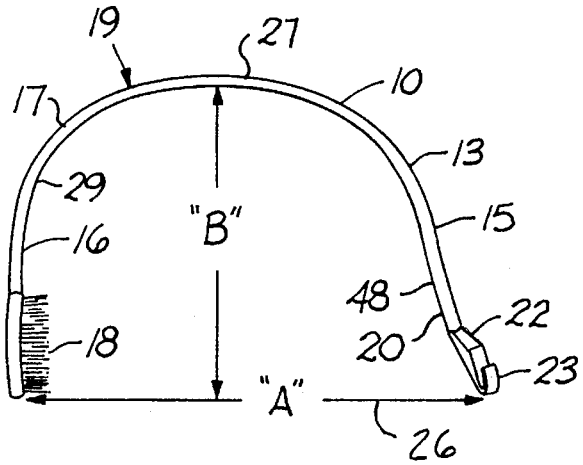
FIG. 2 is a plan view of the brush of FIG. 1.

As shown in FIG. 2, the U-shaped support body 19 comprises a bight portion 27, a first arm 29 connected to bight portion 27 by a curved connector portion 17, and a second arm 15 connected to bight portion 27 by a curved connector portion 13. Terminal end 16 of arm 29 supports brush element 18. Terminal end 20 of arm 15 supports the handle element 22. As shown in FIG. 2, handle element 22 extends from arm 15 away from brush element 18 at an obtuse angle to bight portion 27. The user is thus enabled to comfortably grip handle element 22 with one hand, with his arm extending forwardly from his body. Bight portion 27 forms a hand grip for the other hand of the user.

Figure 3:
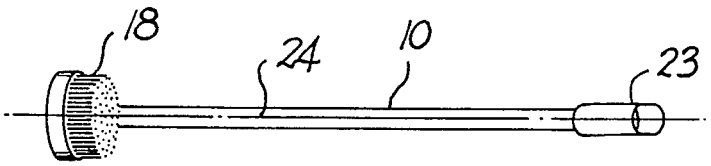
FIG. 3 is a side view of the brush.

Referring to FIG. 3, the elongated tubular body 19 of the brush appliance is bent so as to be generally disposed in a plane 24. It is to be noted that the brush bristles face toward handle 22.

The distance "A" which measures the distance between brush element 18 and handle 22 at opposite ends of the brush appliance is greater than the distance "B" which is the distance between line 26 and the deepest part of the U-shaped body. For illustrative purposes, distance A is about 18½ inches, while depth B is about 13 inches. This configuration provides several advantages. It permits the user to place handle 22 of the body, a sufficient distance in front of his body to apply a leverage against the brush so that the brush provides a pressured cleaning motion to the user's body. Further, it permits the user to apply a substantial leverage on his body with neither arm being raised to the height of his shoulders.

For example, as illustrated in FIG. 1, the body of the brush is placed beneath the user's left arm 30. The midsection of the brush is held by his left hand 32 while his right hand 34 grasps the brush handle. The user can apply either an up and down motion illustrated by arrows 36 by raising and lowering his hands, or he can swing his right hand about the fulcrum formed by his left hand 32 by moving the handle back and forth, which in turn, causes the brush to swing back and forth.

Figure 4:
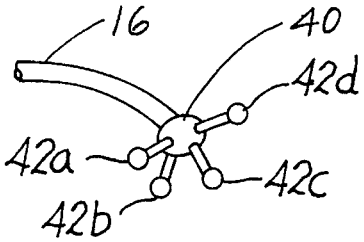
FIG. 4 is a view of the body of the brush in which a massaging element has replaced the brush.

Referring to FIG. 4, brush 18 is replaced with a massaging device 40 on the end 16 of the body. The massaging device can take a variety of shapes, but, preferably comprises four wooden balls 42*a*, 42*b*, 42*c* and 42*d*. The user can apply significant pressure on the massaging device 40 because the leverage of his right hand in front of the brush pushing outwardly from his body causes the massaging device to apply a substantial force toward his back.

Figure 5:
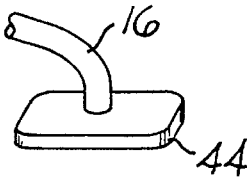
FIG. 5 is a view of the brush in which a heat treatment element has replaced the brush.

FIG. 5 illustrates still another embodiment of the invention in which a heating pad 44 has replaced brush 18. The heating pad device may be either an electrical device or it can be of the type in which a chemical creates heat when exposed to air. This permits the user to easily apply the heat from pad 44 to any desired location of his back.

The embodiment of FIG. 1 employs a body in which the two legs of the "U" are substantially of the same length with the handle 22 being bent at 48, as illustrated in FIG. 2, away from brush 18 but still lying in the same plane in order to provide a convenient grasping structure for the user.

Figure 6:
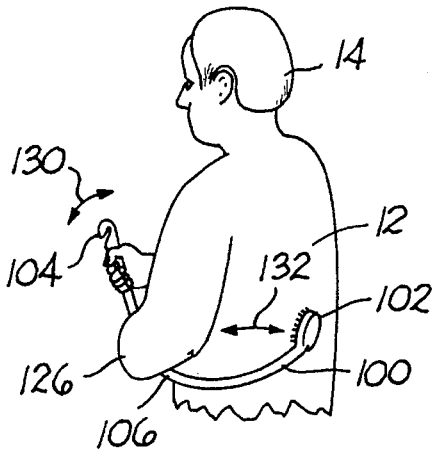
FIG. 6 is a view of another embodiment of the invention.
Figure 7:
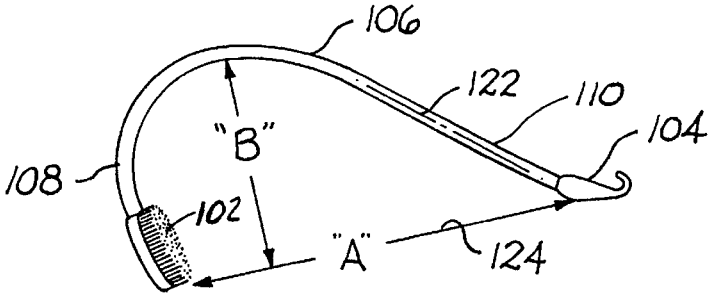
FIG. 7 is a plan view of the brush of FIG. 6.
Figure 8:
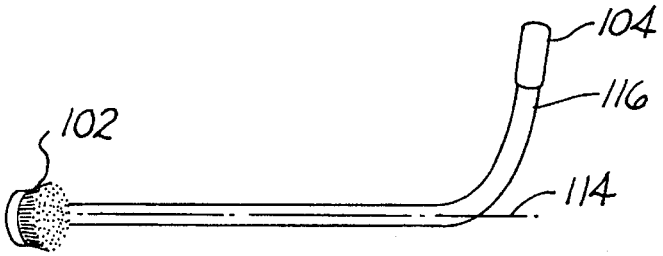
FIG. 8 is a side view of the brush.

Referring to FIGS. 6–8, another embodiment of the invention in the form of an appliance 100 is illustrated for treating back 12 of the user. In this form of the invention, appliance 100 has an elongated configuration with a brush 102 at one end and the other end carrying a hook-shaped handle 104. The body 106 of the brush has a somewhat J-shaped configuration with the brush being attached to short arm 108. The long arm 110 of the body has a linear configuration.

The major portion of the body, as illustrated in FIG. 8, lies in a plane 114. The body may be formed of a sturdy, rigid, solid plastic material, or it can be formed of a tubular material, such as lightweight aluminum.

Brush 102 faces generally toward handle 104.

The outer end of the body is bent upwardly and away from plane 114 of the body and generally transverse to the longitudinal axis 122 of the linear section 110. Typically, the distance "A" from the brush to handle 104 is about 21 inches. The depth "B" of the J-shaped configuration is about 10" measured from a line 124 extending from the tip of the brush to the tip of the handle.

In use, the user places the body 106 of the brush beneath his arm. The body is held by his left hand 126 with handle 104 being disposed in front of his body and forward of his body. The shape of the long end of the body permits the user to swing the handle in a back and forth direction generally indicated by the arrows 130 such that the linear section 110 remains somewhat stationary, but is turned about its longitudinal axis which causes brush 102 to swing back and forth in the direction of arrows 132 in a scrubbing motion. The user can easily maintain his hands in a position below his shoulders.

Having described my invention, I claim:

1. A back appliance comprising:

an elongated rigid support body (19) having a generally U-shaped configuration, said U-shaped body comprising a bight portion, a first arm, and a second arm extending in a common plane (24);

said first arm extending approximately normal to said bight portion whereby said first arm can extend across the back of the person using the appliance; said first arm having a first curved connector portion (17) joining said first arm to said bight portion, so that said connector portion conforms generally to the side surface contour of the person using the appliance;

said first arm having a first terminal end remote from said bight portion, and a working element (18) on said terminal end having a working surface engageable against the person's back;

said second arm angling from said bight portion in a spaced relationship to said first arm, whereby said second arm extends in front of the person using the appliance, said second arm having a second curved connector portion (13) joining said second arm to said bight portion whereby the elongated U-shaped support body has a relatively smooth continuous surface adapted to partially encircle the body of the person using the appliance;

said second arm having a second terminal end remote from said bight portion, and a handle (22) on said second terminal end adapted for gripping by one hand of the person using the appliance, said handle extending angularly away from said working element at an obtuse angle to said bight portion, and non-parallel to the working surface of the working element whereby the person can grip the handle, with his arm extending forwardly from his body;

said working element being spaced from said handle along an imaginary line (A) that is larger than the maximum distance (B) from said imaginary line to said bight portion;

the handle and the working element each being spaced generally the same distance from the bight;

said bight portion forming a hand grip for the other hand of the person using the appliance, whereby the person can use various combinations of hand motions to shift said working element horizontally across his back or up and down on his back.

2. The back appliance of claim 1, wherein said rigid support body is a single elongated tubular member.

3. The back appliance of claim 1, wherein said working element is a brush having bristles that face said handle.

4. The back appliance of claim 1, wherein said working element is a heating pad means.

5. The back appliance of claim 1, wherein said working element is a body massage means.

* * * * *